US006974073B1

(12) United States Patent
Snyder

(10) Patent No.: US 6,974,073 B1
(45) Date of Patent: Dec. 13, 2005

(54) DURABLE DESIGN MAILBOX

(76) Inventor: Harry Snyder, 630 W. Old York Rd., Carlisle, PA (US) 17013

( * ) Notice: Subject to any disclaimer, the term of this patent is extended or adjusted under 35 U.S.C. 154(b) by 0 days.

(21) Appl. No.: 10/847,186

(22) Filed: May 17, 2004

(51) Int. Cl.[7] ..... B65D 91/00
(52) U.S. Cl. ..... 232/29; 232/17; 232/38; 232/1 C
(58) Field of Search ..... 232/29, 33, 24, 232/17, 38, 1 C, 45; D99/29–32

(56) References Cited

U.S. PATENT DOCUMENTS

| | | | | |
|---|---|---|---|---|
| 3,243,104 A | * | 3/1966 | Fillion | 232/33 |
| D324,444 S | | 3/1992 | Cummings | |
| D328,513 S | | 8/1992 | McKinney | |
| 5,148,974 A | | 9/1992 | Clapper | |
| 5,178,320 A | | 1/1993 | Bertone | |
| D344,392 S | | 2/1994 | Gardner | |
| D348,554 S | | 7/1994 | Shapiro et al. | |
| D350,003 S | | 8/1994 | Rentz | |
| D354,611 S | | 1/1995 | Hazlett | |
| 5,433,376 A | | 7/1995 | Kueshner | |
| 5,465,902 A | * | 11/1995 | Hanson | 232/33 |
| D365,190 S | | 12/1995 | Albanesius | |
| D371,889 S | | 7/1996 | Esgro | |
| D385,680 S | * | 10/1997 | Cacciola et al. | D99/29 |
| D385,682 S | * | 10/1997 | Erwin | D99/31 |
| 6,662,997 B1 | * | 12/2003 | Smith et al. | 232/39 |

* cited by examiner

*Primary Examiner*—William L. Miller
(74) *Attorney, Agent, or Firm*—Powell & Powell, PC; Mary Howard Powell

(57) ABSTRACT

The present invention is directed to a durable mailbox which has an aerodynamic design that protects the mailbox from destructive elements such as weather and flying projectiles. The present mailbox has an aerodynamic design that slopes down from the left to the right. The descending slope design reduces the surface impact caused by projectile matter.

10 Claims, 6 Drawing Sheets

DURABLE DESIGN MAILBOX

CROSS REFERENCE TO RELATED APPLICATION

A related design patent application is being filed concurrent with the present application similarly entitled Durable Design Mailbox, Ser. No. 29/205,560.

BACKGROUND OF INVENTION

1. Field of Invention

The present invention relates to an aerodynamically designed mailbox. The mailbox of the present invention is designed to withstand destructive elements in rural and residential neighborhoods. There is a never ending battle in rural and residential communities to keep mailboxes from being destroyed. In winter snowplows often cause irreversible damage from heavy flying snow and slush. In summer, youth find it entertaining to drive by mailboxes with baseball bats, knocking them down or damaging them.

The present invention has a unique aerodynamic design and co-adaptive delivery capacity as it accepts both U.S. postal mail and non-postal mail such as newspapers and magazines. It is very resistant to damage from snow plowing and vandalism. The present mailbox has an aerodynamic design that slopes down from the left to the right. The descending slope design reduces the surface impact caused by projectile matter. Matter moving toward the mailbox is deflected in an upward and downward motion similar to an aerodynamic airplane wing design interaction with air.

2. Description of the Prior Art

Prior to the present invention, mailboxes did not utilize an aerodynamic design to protect said mailboxes from destructive elements such as weather and flying projectiles.

A number of mailboxes exist in the prior art. A limited number of patents exist that disclose a protection apparatus for mailboxes. For example, U.S. Pat. No. Des. 365,190 of Albanesius is directed to a mailbox with a roadside protector. The roadside protector is flat and vertical and has no aerodynamic aspects to it. U.S. Pat. No. 5,178,320 of Clapper is directed to a security mailbox including an upper compartment for conventional and a lower compartment for secured deposit of mail. U.S. Pat. No. 5,178,320 of Bertone is directed to a mailbox which has an access door provided with a concealed counterweight to assure that the door closes after use. U.S. Pat. No. 5,433,376 of Kueshner is directed to a retractable and extendable mailbox.

None of this prior art discloses the present invention.

SUMMARY OF THE INVENTION

The present invention is directed to a durable mailbox which has an aerodynamic design that protects the mailbox from destructive elements such as weather and flying projectiles. The invention has three basic designs i) a complete unit; ii) a replacement unit; and iii) a strap-on modification unit. The complete unit has a post as an integral part thereof. The replacement unit comes without the post but it attaches to a post by post attachment means. The strap-on modification unit is placed over an existing mailbox and secured underneath with strap attachment means.

The present invention consists of i) a housing means having spaced apart left side wall, right side wall, roof, rear wall, door and a floor spanning the area between said left side wall and right side wall; and ii) a triangular member having three legs formed as a triangle and affixed to the right side wall outer surface of the housing means, said triangular member having leg one which slopes down from an uppermost point on the right side wall and extending the length of the right side wall, leg two which extends in a straight line from the lowest outer surface of the right side wall and attaching to leg one at its lower end and leg three affixed to and extending vertically the height of the right side wall connecting at its ends with leg one and leg two, the triangular member having a vacant space at its center and having one end closed with a back wall.

BRIEF DESCRIPTION OF THE DRAWINGS

These as well as other features of the present invention will become more apparent upon reference to the drawings wherein.

DETAILED DESCRIPTION OF THE INVENTION

Figure 1:
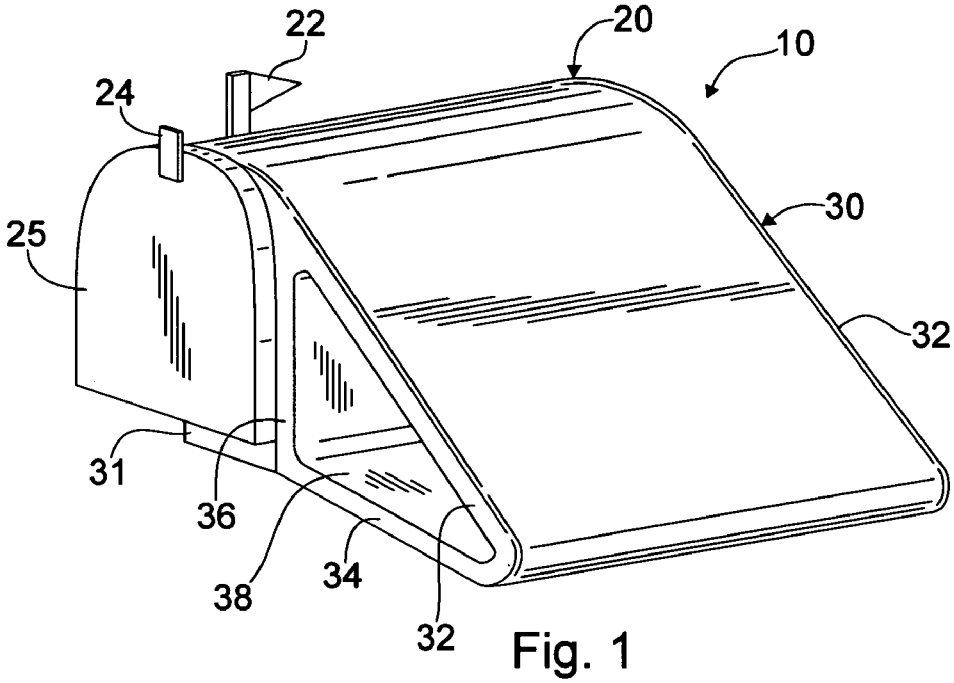
FIG. 1 is a perspective view of a DURABLE DESIGN MAILBOX showing a replacement mailbox which is an aspect of my new design.
Figure 2:
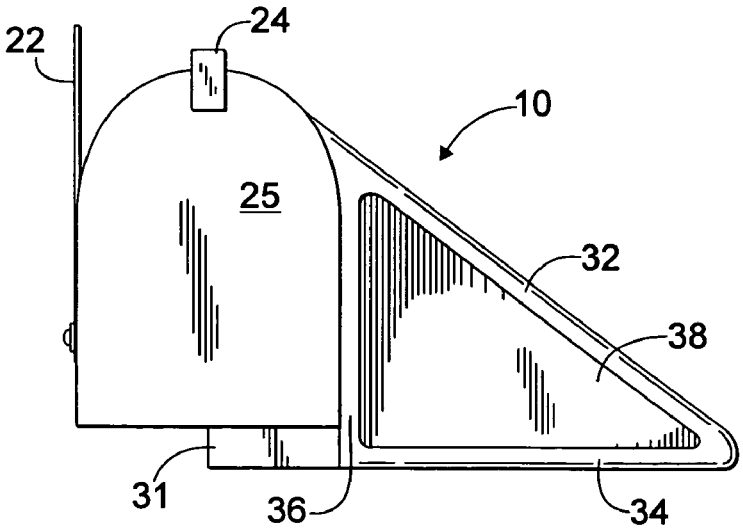
FIG. 2 is a front view of a DURABLE DESIGN MAILBOX showing a replacement mailbox which is an aspect of my new design.

It was found that the present mailbox using an aerodynamic design withstands many destructive elements in both rural and residential communities.

Referring to the drawings, FIGS. 1–11 illustrate an aerodynamic designed durable mailbox referred to by the general reference character 10.

The present invention 10 is primarily used as a protective device to shield mailboxes from projectile matter. The present invention slopes from the left to the right coming to a point on the right side. This descending slope design reduces the surface impact caused by projectile matter. The left side is similar to many mailboxes well known in the art.

It is not normally impacted by projectile matter due to the direction of traffic flow in the United States.

The principal design is an aerodynamic durable mailbox 10 for deposit of mail, having a housing means 20 with spaced apart left side wall 21, right side wall 23, roof 26, rear wall, door 25 and a floor 28 spanning the area between said left side wall 21 and right side wall 23; and a triangular member 30 having three legs formed as a triangle and affixed to the right side wall 23 outer surface of the housing means 20, said triangular member 30 having leg one 32 which slopes down from an uppermost point on the right side wall 23, leg two 34 which extends in a straight line from the lowest outer surface of the right side wall 23 and attaching to leg one 32 at its lower end and leg three 36 affixed to and extending the length of the right side wall 23 connecting at its ends with leg one 32 and leg two 34, the triangular member 30 having a vacant space 38 in its center and having one end closed with a back wall or both ends open, preferably, one end closed. The vacant space 38 in the center of the triangular member 30 is a convenient storage place for non-postal mail and periodicals. The present invention is constructed of rigid, durable, high impact material, preferably plastic or metal, more preferably plastic.

The present invention attaches to a vertical member, preferably a post 40, as mailboxes customarily do, such posts and post attachment means are well known in the art.

This invention is either made as one complete unit, a replacement unit or a strap-on modification unit 50. The complete unit is one continuous article of manufacture including post 40. The replacement unit is a complete unit without a post attached. These units attach to posts 40 by post attachment means 31.

A further aspect of the present invention is a strap-on modification unit 33 which is used to place the triangular member 30 of this invention onto existing mailboxes 60 thus providing existing mailboxes 60 with the advantages of the present invention without replacing an existing mailbox 60. The strap-on modification unit 50 has straps 52 which encircle the existing mailbox 60 and are secured to the floor 28 of the existing mailbox 60 by strap attachment means 53. The strap attachment means may be secured by any attachment means well known in the art such as screws, nails, heavy duty staples and welding. The straps are constructed from the same material as the triangular member 30, selected from rigid, durable, high impact material, preferably plastic or metal, more preferably plastic.

FIG. 1 illustrates a perspective view of a DURABLE DESIGN MAILBOX 10 showing a replacement mailbox which is also illustrated in co-pending U.S. Design Patent Application, Ser. No. 29/205,560, being filed concurrent with this Patent Application. Shown is housing means 20 wherein housing means 20 is selected from the group consisting of an existing mailbox 60, a replacement mailbox, and a new mailbox completed to the specifications of the present invention, an adornment of the housing means 20 is flag 22 used to signal outgoing mail to postal employees. The flag 22 is well known in the art. However, it is preferred that flag 22 is an oversized outgoing mail flag on the left side of the mailbox that will be both highly visible to the mail carrier and better protected from the elements than in the prior art. Also shown is triangular member 30 having three legs formed as a triangle and affixed to the right side wall 23 outer surface of the housing means 20, said triangular member 30 having leg one 32 which slopes down from an uppermost point on the right side wall 23 and extends the length of the right side wall 23, leg two 34 which extends in a straight line from the lowest outer surface of the right side wall 23 and attaches to leg one 32 at its lower end and leg three 36 affixed to and extending vertically the height of the right side wall 23 connecting at its ends with the leg one 32 and leg two 34, the triangular member 30 having a vacant space 38 in its middle. The vacant space 38 in the middle of the triangular member 30 is a convenient storage place for non-postal mail, newspapers, periodicals and circulars.

Figure 3:
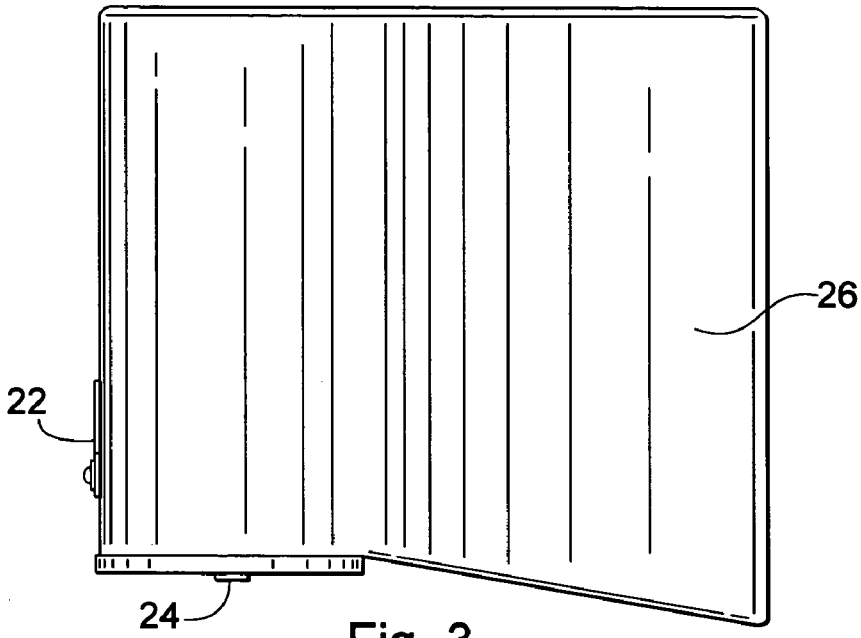
FIG. 3 is a top view of a DURABLE DESIGN MAILBOX showing a replacement mailbox which is an aspect of my new design.

FIG. 3 illustrates a top view of a DURABLE DESIGN MAILBOX 10 showing a replacement mailbox. It shows the roof 26, flag 22 and door fastener 24.

Figure 4:
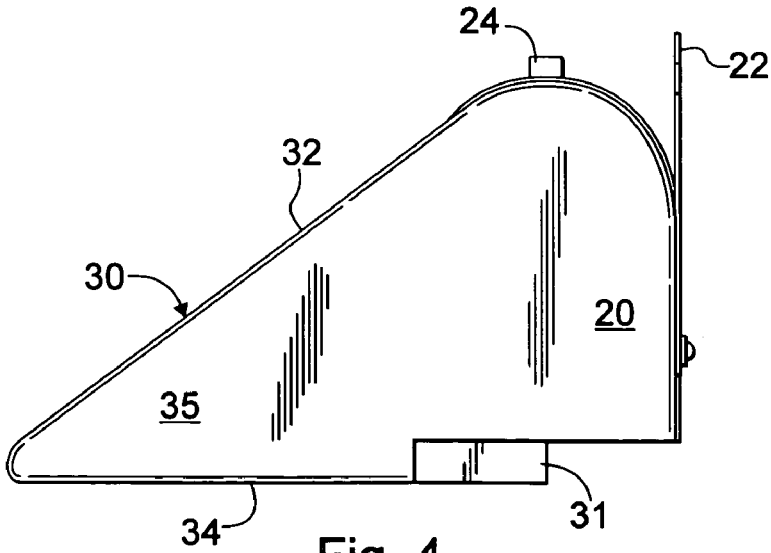
FIG. 4 is a rear view of a DURABLE DESIGN MAILBOX showing a replacement mailbox which is an aspect of my new design.

FIG. 4 illustrates a rear view of a DURABLE DESIGN MAILBOX 10 showing a replacement mailbox. It shows the triangular member 30, back wall of the triangular member 35, roof 26, flag 22, and attachment means 31.

Figure 5:
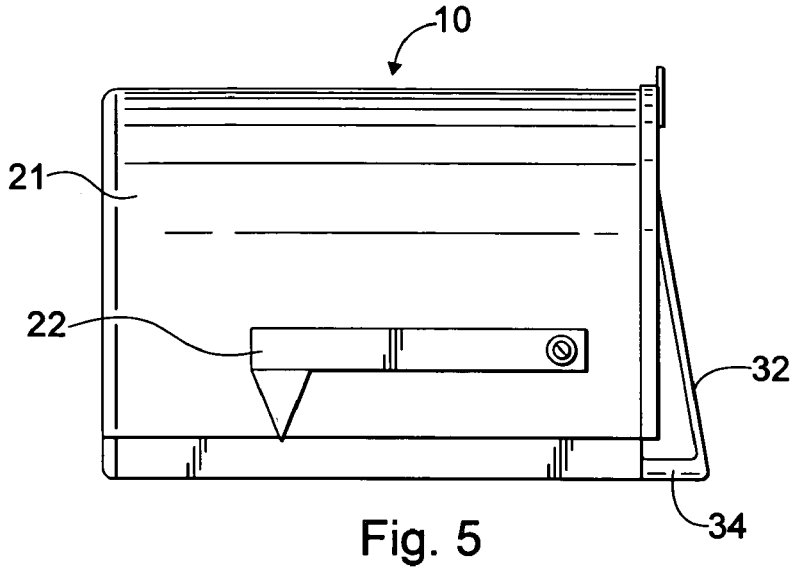
FIG. 5 is a left side view of a DURABLE DESIGN MAILBOX showing a replacement mailbox which is an aspect of my new design.

FIG. 5 illustrates a left side view of a DURABLE DESIGN MAILBOX 10 showing a replacement mailbox. The left side is a customary mailbox left wall well known in the art which is not impacted by the present invention due to the direction of traffic flow in the United States.

Figure 6:
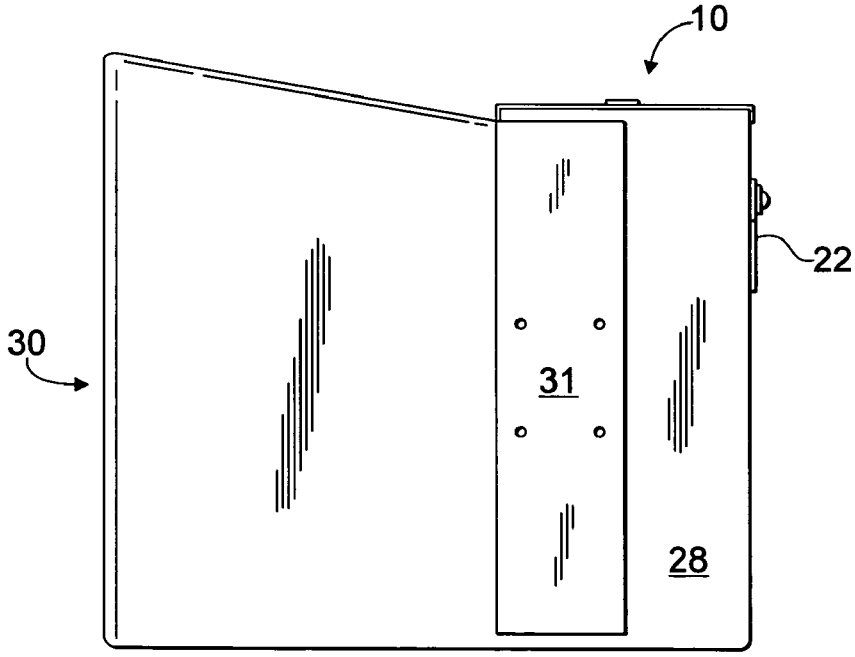
FIG. 6 is a bottom view of a DURABLE DESIGN MAILBOX showing a replacement mailbox which is an aspect of my new design.

FIG. 6 illustrates a bottom view of a DURABLE DESIGN MAILBOX 10 showing a replacement mailbox and post attachment means 31.

Figure 7:
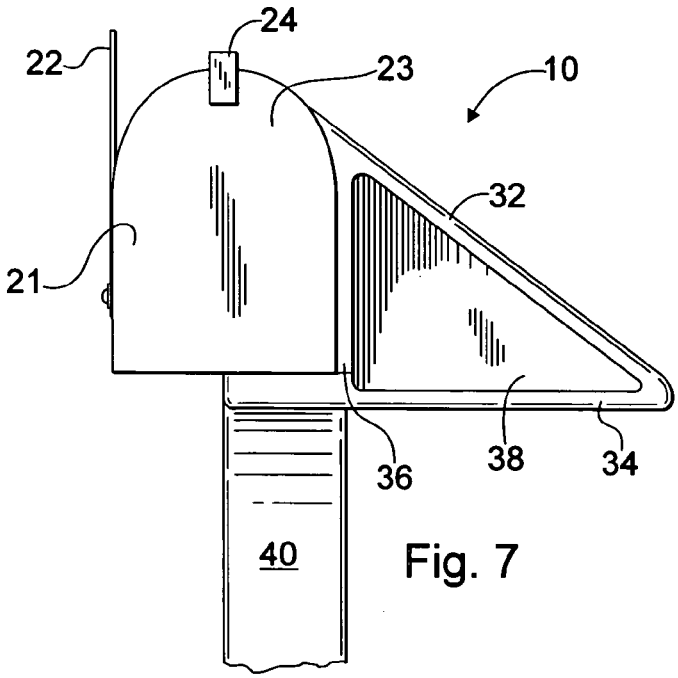
FIG. 7 is a front view of a DURABLE DESIGN MAILBOX, with a post as an integral part thereof, showing a complete unit which is an aspect of my new design.

FIG. 7 illustrates a front view of a DURABLE DESIGN MAILBOX 10 showing a complete unit with an attached post 40 with the post 40 broken for convenience of illustration. It also shows the triangular member 30 having leg one 32, leg two 34 and leg three 36, paper holder 38, door 25, door fastener 24, right side wall 23, and flag 22.

Figure 8:
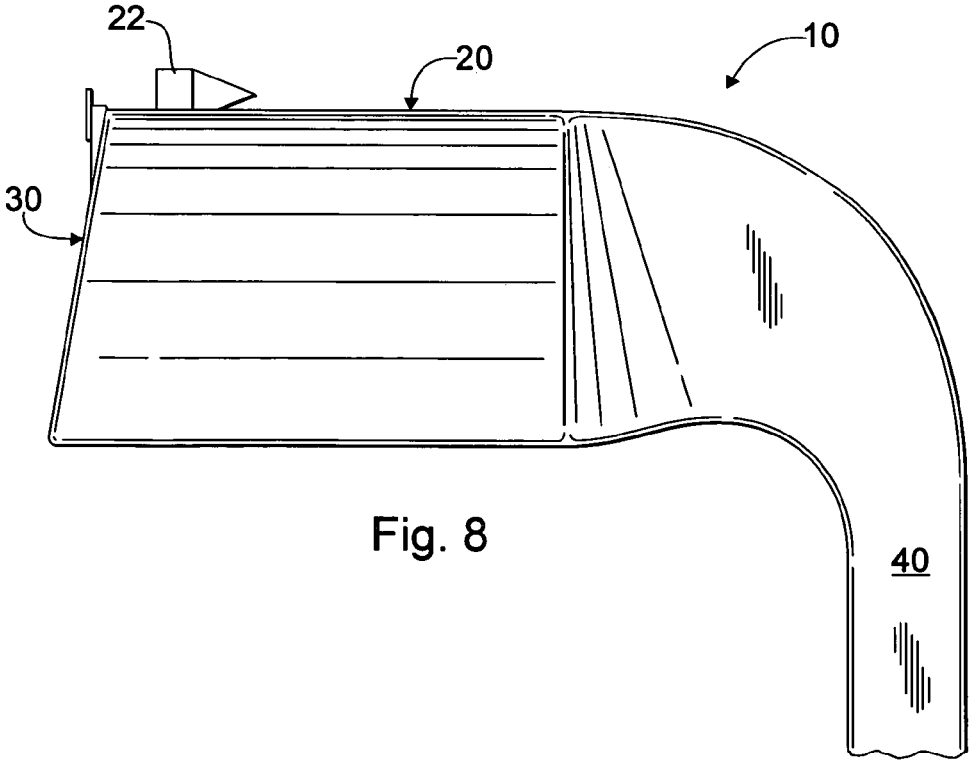
FIG. 8 is a right side view of a DURABLE DESIGN MAILBOX with an attached post, showing a complete unit which is an aspect of my new design.

FIG. 8 illustrates a right side view of a DURABLE DESIGN MAILBOX 10 showing a complete unit, with a post 40. The post 40 can be attached independently by post attachment means 31 or the invention can be made as one continuous article as depicted in this figure. This figure shows post 40, flag 22, triangular member 30 and housing means 20.

Figure 9:
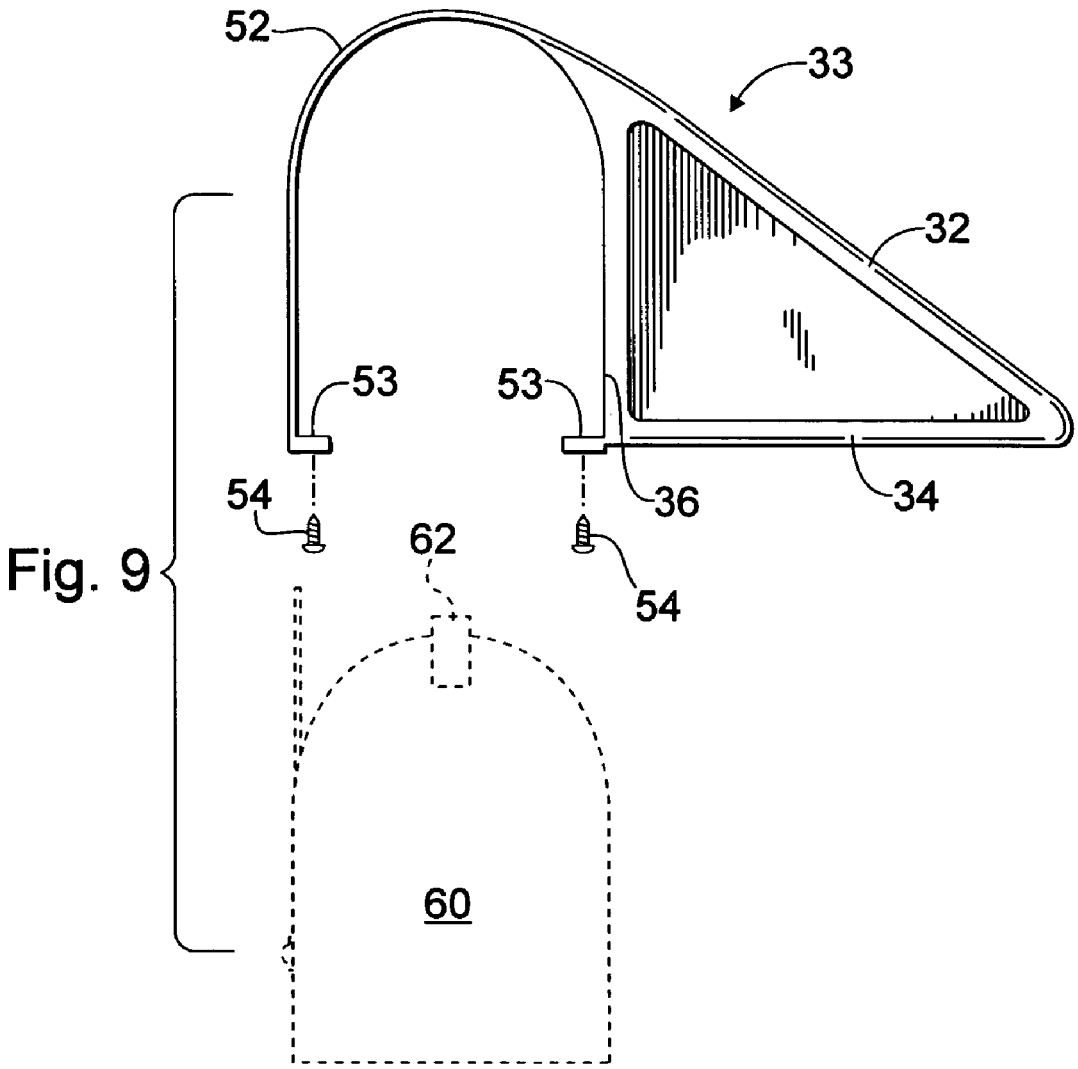
FIG. 9 is a perspective view of a DURABLE DESIGN MAILBOX showing a strap-on modification unit which is an aspect of my new design, the existing mailbox being shown in broken lines.

FIG. 9 illustrates a perspective view of a DURABLE DESIGN MAILBOX 10 showing a strap-on modification unit 50 the existing mailbox 60 being shown in broken lines. This figure introduces the strap-on aspect of the present invention and depicts how this device attaches to an existing mailbox 60 fastening under the floor. This figure shows existing mailbox 60, the triangular member 30 having leg one 32, leg two 34 and leg three 36, paper holder 38, straps 52, strap attachment means 53, and screws 54. Shown also is the post 40 cut off for ease of view.

Figure 10:
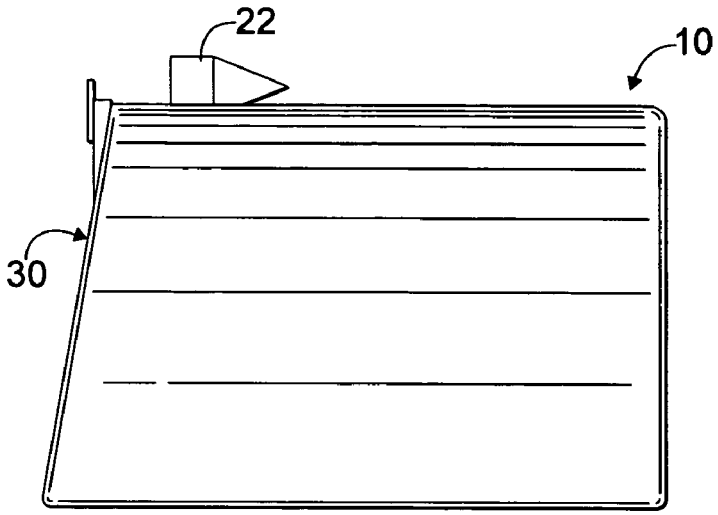
FIG. 10 is a right side view of a DURABLE DESIGN MAILBOX showing a strap-on modification unit which is an aspect of my new design.

FIG. 10 illustrates a right side view of a DURABLE DESIGN MAILBOX 10 showing a strap-on modification unit 50.

Figure 11:
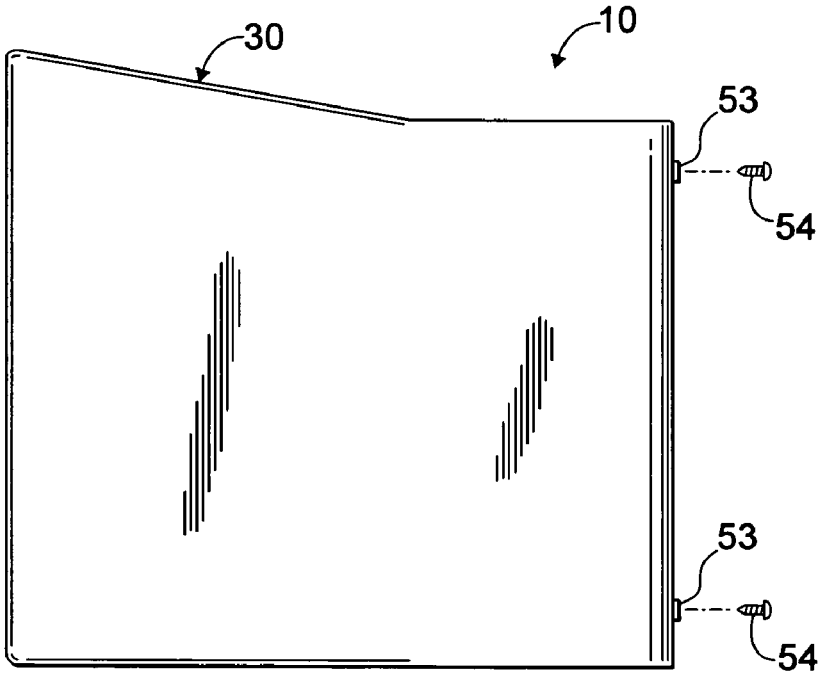
FIG. 11 is a bottom view of a DURABLE DESIGN MAILBOX showing a strap-on modification unit which is an aspect of my new design.

FIG. 11 illustrates a bottom view of a DURABLE DESIGN MAILBOX 10 showing a strap-on modification unit 50. It shows the floor 28, triangular member 30, and attachment means 53.

Changes and modifications in the specifically described embodiments can be carried out without departing from the scope of the invention which is intended to be limited only by the scope of the appended claims.

What is claimed is:

1. A durable mailbox for deposit of mail, said mailbox comprising a) a housing means for receiving mail therein, said housing means having spaced apart left side wall, right side wall, roof, rear wall, door and a floor spanning the area between said left side wall and right side wall; and b) a triangular member having three legs formed as a triangle and affixed to the right side wall outer surface of the housing means, said triangular member having leg one which slopes down from an uppermost point on the right side wall and extending the length of the right side wall, leg two which extends in a straight line from the lowest outer surface of the right side wall and attaching to said leg one at the lower end of said leg one, and leg three affixed to and extending vertically the height of the right side wall the ends of said leg three connecting with said leg one and said leg two, the triangular member having a vacant space in a center thereof for receiving non-mail items therein, and having one end closed with a back wall.

2. A durable mailbox of claim 1 further comprising a vertical support member.

3. A durable mailbox of claim 2 wherein the vertical support member is a post.

4. A durable mailbox of claim 3 wherein the triangular member is aerodynamic in shape.

5. A durable mailbox of claim 4 wherein the vacant space of the triangular member accommodates the non-mail items selected from the group consisting of newspapers, magazines and circulars.

6. A durable mailbox of claim 3 wherein the mailbox is a complete unit being one continuous article of manufacture.

7. The durable mailbox of claim 3 wherein the mailbox is a complete unit having the post attached thereto by post attachment means.

8. A durable mailbox of claim 1 wherein the triangular member is a removable strap-on modification unit.

9. A durable mailbox of claim 8 wherein the removable strap-on modification unit fits over the roof of the housing means and attaches to the floor of the housing means.

10. The durable mailbox of claim 1 further comprising an oversized outgoing mail flag on the left side of the mailbox.

* * * * *